US011212609B1

(12) United States Patent
Belanger et al.

(10) Patent No.: US 11,212,609 B1
(45) Date of Patent: Dec. 28, 2021

(54) WEARABLE AUDIO DEVICE WITH TRI-PORT ACOUSTIC CAVITY

(71) Applicant: Bose Corporation, Framingham, MA (US)

(72) Inventors: Robert Daniel Belanger, Franklin, MA (US); David-Michael Lozupone, Westborough, MA (US); Clayton Jeffrey Pipkin, Highland Park, NJ (US); Matthew J. Greenway, Medway, MA (US); Johnpaul Philias Barrieau, Franklin, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/944,819

(22) Filed: Jul. 31, 2020

(51) Int. Cl.
*H04R 1/10* (2006.01)
*H04R 1/28* (2006.01)

(52) U.S. Cl.
CPC ..... *H04R 1/1083* (2013.01); *H04R 1/2823* (2013.01); *H04R 1/1008* (2013.01); *H04R 1/1016* (2013.01)

(58) Field of Classification Search
CPC .. H04R 1/1083; H04R 1/1008; H04R 1/1016; H04R 1/2823
See application file for complete search history.

(56) References Cited

U.S. PATENT DOCUMENTS

| | | | | |
|---|---|---|---|---|
| 4,644,581 | A | 2/1987 | Sapiejewski | |
| 5,181,252 | A | 1/1993 | Sapiejewski et al. | |
| 6,831,984 | B2 | 12/2004 | Sapiejewski | |
| 9,762,990 | B2 | 9/2017 | Sapiejewski et al. | |
| 2002/0015501 | A1 | 2/2002 | Sapiejewski | |
| 2014/0286521 | A1* | 9/2014 | Yang | H04R 1/1041 381/380 |
| 2015/0382100 | A1* | 12/2015 | Azmi | H04R 1/1016 381/380 |
| 2016/0029137 | A1* | 1/2016 | Price | H04R 1/2823 29/594 |
| 2020/0178003 | A1 | 6/2020 | Zurbruegg et al. | |
| 2021/0105555 | A1* | 4/2021 | Shen | H04R 1/1008 |

OTHER PUBLICATIONS

PCT International Search Report and Written Opinion for International Application No. PCT/US2021/041056, dated Nov. 2, 2021, 25 pages.

* cited by examiner

*Primary Examiner* — Jason R Kurr
(74) *Attorney, Agent, or Firm* — Hoffman Warnick LLC

(57) ABSTRACT

Various aspects include ported wearable audio devices. In certain implementations, a wearable audio device includes: a first cavity; a second cavity; a third cavity; a driver disposed between the first cavity and the second cavity, the driver configured to provide an acoustic output; a first mass and/or resistive port connecting the second cavity and the third cavity; and a second mass and/or resistive port connected to the third cavity.

15 Claims, 6 Drawing Sheets

WEARABLE AUDIO DEVICE WITH TRI-PORT ACOUSTIC CAVITY

TECHNICAL FIELD

This disclosure generally relates to wearable audio devices. More particularly, the disclosure relates to porting in wearable audio devices.

BACKGROUND

Conventional ported wearable audio devices can suffer from poor or insufficient passive noise attenuation, particularly across a range of environments (e.g., in both quieter and louder environments).

SUMMARY

All examples and features mentioned below can be combined in any technically possible way.

Various implementations of the disclosure include ported wearable audio devices configured to provide desirable passive noise attenuation and mass loading across a range of environments. In certain implementations, a wearable audio device includes: a first cavity; a second cavity; a third cavity; a driver disposed between the first cavity and the second cavity, the driver configured to provide an acoustic output; a first mass and/or resistive port connecting the second cavity and the third cavity; and a second mass and/or resistive port connected to the third cavity.

In some particular aspects, a wearable audio device includes: a set of earpieces, each having: a first cavity; a second cavity; a third cavity; a driver disposed between the first cavity and the second cavity, the driver configured to provide an acoustic output; a first mass and/or resistive port connecting the second cavity and the third cavity; and a second mass and/or resistive port connected to the third cavity, where the second cavity has a smaller acoustic volume than the first cavity and the third cavity, and where the third cavity and the second mass and/or resistive port maintain passive attenuation of an ear canal of a user at frequencies of ambient noise that range between approximately 500 Hertz (Hz) and approximately 2,000 Hz, while maintaining compliance at frequencies below approximately 500 Hz.

In other particular aspects, a wearable audio device includes: a set of earpieces, each having a cover at least partially containing: a first cavity; a second cavity; a third cavity; a driver disposed between the first cavity and the second cavity, the driver configured to provide an acoustic output; a first mass and/or resistive port connecting the second cavity and the third cavity; and a second mass and/or resistive port connected to the third cavity, where the cover defines an outer bound of the third cavity, where the second mass and/or resistive port is the only outlet to ambient from the third cavity, and where the third cavity and the second mass and/or resistive port maintain passive attenuation of an ear canal of a user at frequencies of ambient noise that range between approximately 500 Hertz (Hz) and approximately 2,000 Hz, while maintaining compliance at frequencies below approximately 500 Hz.

Implementations may include one of the following features, or any combination thereof.

In certain aspects, the wearable audio device further includes: at least one mass port connected to the second cavity; at least one resistive port connected to the second cavity; and an additional port connected to the first cavity, the second cavity, the third cavity or ambient.

In some cases, the additional port includes a mass and/or resistive port.

In particular implementations, the wearable audio device further includes at least one additional mass and/or resistive port connected to the third cavity.

In certain aspects, the at least one additional mass and/or resistive port includes three or more additional mass and/or resistive ports.

In some cases, the first mass and/or resistive port is further connected to the third cavity and/or ambient.

In particular aspects, the wearable audio device includes one of: an over-ear audio device, an on-ear audio device or an in-ear audio device.

In certain implementations, each mass and/or resistive port includes: a) a mass port; b) a resistive port; c) a mass port and a resistive port; or d) a single port that is both massive and resistive.

In some cases, the wearable audio device further includes a cover defining the third cavity.

In certain aspects, the second mass and/or resistive port is the only outlet to ambient from the third cavity.

In particular implementations, the cover is part of the outermost layer of the wearable audio device such that the second mass and/or resistive port vents to ambient.

In some aspects, the wearable audio device further includes an equalization port connected to the front cavity.

In certain cases, the second cavity has a smaller acoustic volume than the first cavity and the third cavity.

In particular aspects, the third cavity and the second mass and/or resistive port maintain passive attenuation of an ear canal of a user at frequencies of ambient noise that range between approximately 500 Hertz (Hz) and approximately 2,000 Hz, while maintaining compliance at frequencies below approximately 500 Hz.

In certain implementations, the third cavity and the second mass and/or resistive port act as a low pass filter at frequencies of ambient noise below approximately 500 Hz.

In some aspects, each mass port permits airflow between adjoining cavities.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

Figure 1:
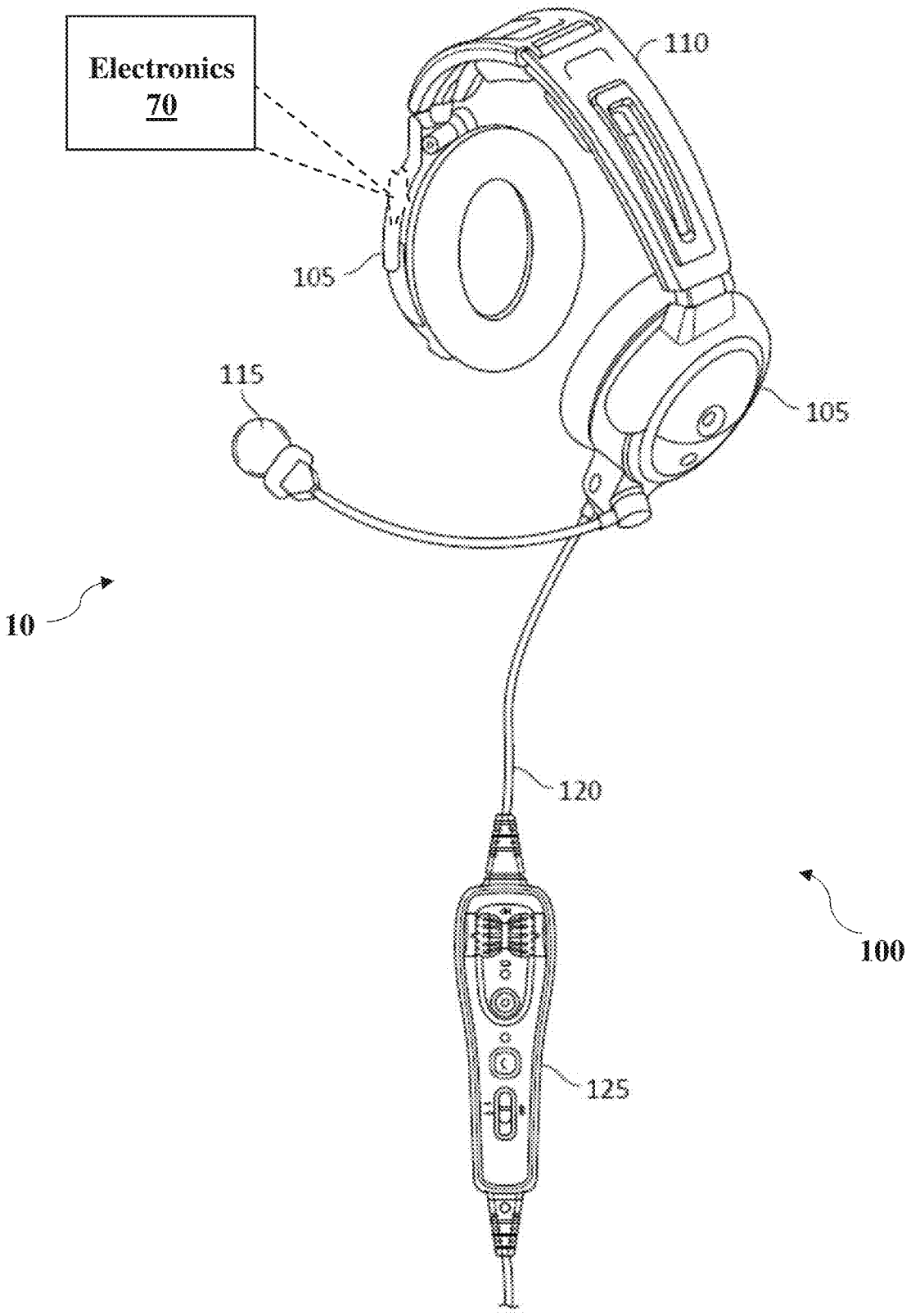
FIG. 1 is a schematic depiction of an audio device according to various implementations.

It is noted that the drawings of the various implementations are not necessarily to scale. The drawings are intended to depict only typical aspects of the disclosure, and therefore should not be considered as limiting the scope of the invention. In the drawings, like numbering represents like elements between the drawings.

DETAILED DESCRIPTION

As noted herein, various aspects of the disclosure generally relate to ported wearable audio devices. More particularly, aspects of the disclosure relate to wearable audio devices with a ported outer cavity that controls passive noise attenuation and mass loading. When compared with conventional ported wearable audio devices, the ported wearable audio devices according to various implementations provide numerous benefits. For example, by providing effective passive noise attenuation and mass loading across a range of ambient environments (e.g., quieter to louder environments), the wearable audio devices can enhance the user experience when compared to conventional devices. Additionally, the wearable audio devices according to various implementations can be beneficial in aviation, military and other environments where either high ambient pressure conditions, or significant changes in ambient pressure conditions, are common.

Commonly labeled components in the FIGURES are considered to be substantially equivalent components for the purposes of illustration, and redundant discussion of those components is omitted for clarity.

Aspects and implementations disclosed herein may be applicable to a wide variety of wearable audio devices. In some cases, wearable audio devices can take various form factors, such as earpieces, also collectively called "headphones" (whether on or off ear), headsets, watches, eyeglasses, audio accessories or clothing (e.g., audio hats, audio visors, audio jewelry), neck-worn speakers, shoulder-worn speakers, body-worn speakers, etc. Some aspects disclosed may be particularly applicable to personal (wearable) audio devices such as over-ear headphones, on-ear headphones, in-ear headphones (also referred to in these cases as earbuds), audio eyeglasses or other head-mounted audio devices. Some example implementations relate to audio devices that include aviation headsets, e.g., for connecting with aircraft, air traffic control (ATC), and/or pilot-to-pilot communication systems. However, aviation headsets are only one example form of audio device configured to utilize the various implementations disclosed herein.

The wearable audio devices described according to various implementations can include features found in one or more other wearable electronic devices, such as smart glasses, smart watches, etc. These wearable audio devices can include additional hardware components, such as one or more cameras, location tracking devices, microphones, etc., and may be capable of voice recognition, visual recognition, and other smart device functions. The description of wearable audio devices included herein is not intended to exclude these additional capabilities in such a device.

An example of a wearable audio device 10 that includes an aviation headset 100 is shown in FIG. 1. In particular cases, the headset 100 includes a frame that has at least one earpiece (e.g., ear-cup) 105 on each side, which fits on, around, or over the ear of a user. In some cases, the frame is optional, such that the earpiece 105 is either tethered or wirelessly connected to other components in the wearable audio device 10. Each of the ear-cups 105 houses acoustic transducers or speakers. The headset 100 also includes a headband (e.g., an over-the-head bridge) 110 for connecting the two earpieces (e.g., ear-cups) 105. In various implementations, the headset 100 is configured to position at least one, and in some cases both, earpieces 105 proximate ears of the user. For example, the headset 100 (and other headset forms of audio device 10 described herein) can be configured, when worn by a user, to position the earpiece(s) 105 proximate to a user's ear. In certain cases, this proximity includes positioning the earpiece(s) 105 on or over the ears (e.g., using earcups), in the ears (e.g., using earbuds), resting on the ears (e.g., using ear hooks), etc. In some cases, proximate positioning results in full, partial, or no occlusion of the user's ear.

In some implementations, an electronic component (e.g., a microphone such as a boom microphone) 115 may be physically connected to one of the ear-cups 105. The headset 100 can be connected to the aircraft intercom system using the connecting cable 120, which may also include a control module 125 that includes one or more controls for the headset 100. In certain cases, the analog signals to and from the aircraft intercom system are transmitted through the wired connection provided by the connecting cable 120. In other cases, or in additional cases, the headset 100 can include electronics 70, such as control chips and/or circuitry, electro-acoustic transducer(s), microphones and associated modules, power components such as batteries and/or connectors, interface components such as capacitive touch interface components, etc. In particular cases, the electronics 70 include a controller coupled with an electro-acoustic transducer, where the controller is also configured to connect with an electronic component when in a locked position with the audio device 10.

It is further understood that electronics 70 can include other components not specifically depicted in the accompanying FIGURES, such as communications components (e.g., a wireless transceiver (WT)) configured to communicate with one or more other electronic devices connected via one or more wireless networks (e.g., a local WiFi network, Bluetooth connection, or radio frequency (RF) connection), and amplification and signal processing components. Electronics 70 can also include motion and/or position tracking components, such as optical tracking systems, inertial measurement units (IMUs) such as a microelectromechanical system (MEMS) device that combines a multi-axis accelerometer, gyroscope, and/or magnetometer, etc.

While the example in FIG. 1 illustrates an aviation headset that includes around-ear earpieces, i.e., ear-cups, aviation headsets having other form-factors, including those having in-ear earpieces or on-ear earpieces, are also compatible with the technology described herein. In an example involving in-ear earpieces, the over-the-head bridge may be omitted, and the boom microphone may be attached to the user via the headset or via a separate structure. Also, the term headset, as used in this document, includes various types of acoustic devices that may be used for aviation purposes, including, for example, earphones and earbuds. Additional headset features are disclosed, for example, in U.S. patent application Ser. No. 15/238,259 ("Communications Using Aviation Headsets," filed Aug. 16, 2016), which is incorporated herein by reference in its entirety.

It is further understood that any component described as connected or coupled to another component in the audio device 10 or other systems disclosed according to implementations may communicate using any conventional hardwired connection and/or additional communications protocols. In some cases, communications protocol(s) can include a Wi-Fi protocol using a wireless local area network (LAN), a communication protocol such as IEEE 802.11 b/g a cellular network-based protocol (e.g., third, fourth or fifth generation (3G, 4G, 5G cellular networks) or one of a plurality of internet-of-things (IoT) protocols, such as: Bluetooth, BLE Bluetooth, ZigBee (mesh LAN), Z-wave (sub-GHz mesh network), 6LoWPAN (a lightweight IP protocol), LTE protocols, RFID, ultrasonic audio protocols, etc. In various particular implementations, separately housed components in audio device 10 are configured to communicate using one or more conventional wireless transceivers.

Figure 2:
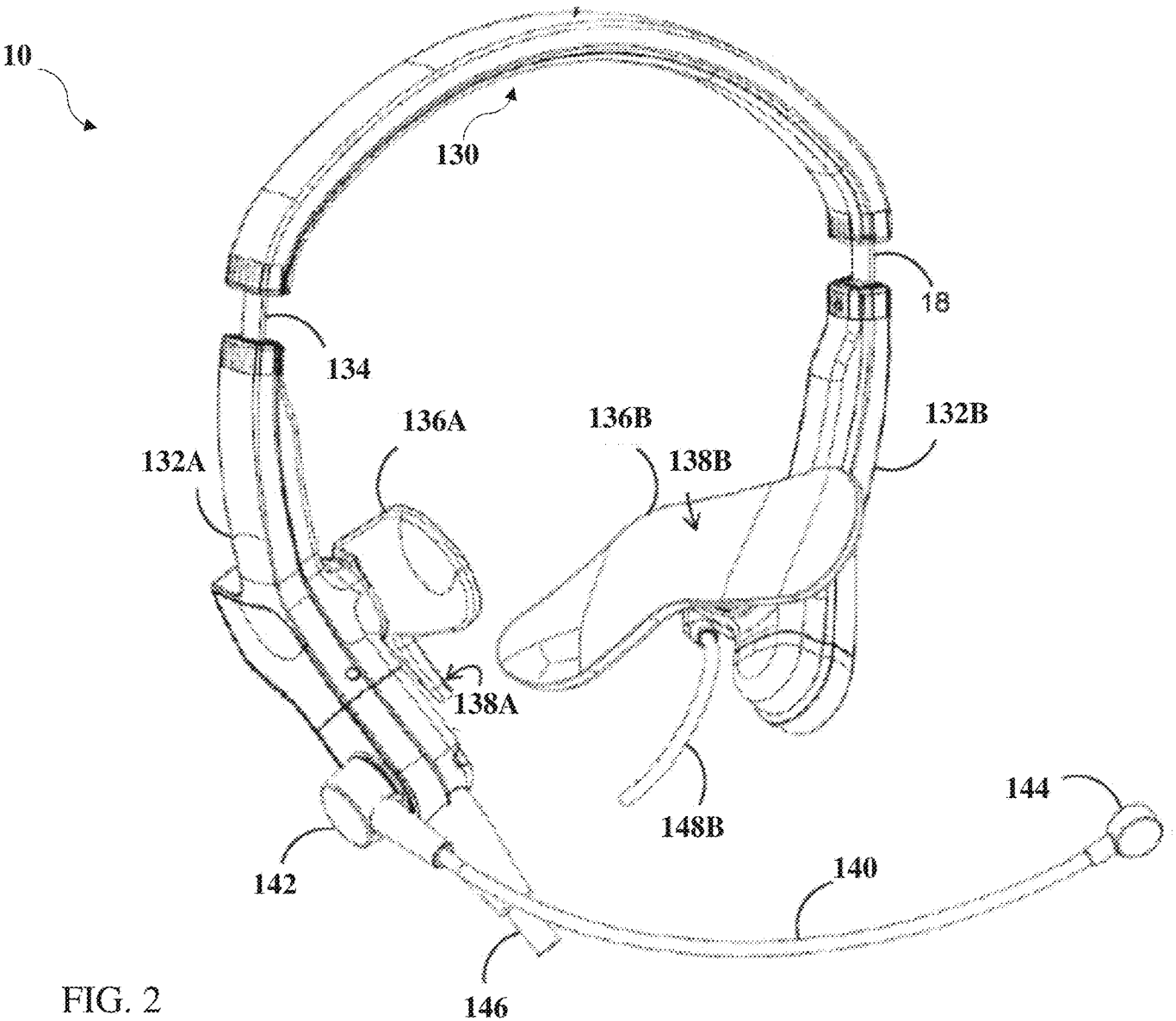
FIG. 2 is a schematic depiction of another audio device according to various implementations.

It is understood that the wearable audio devices 10 according to various implementations can take additional form factors. For example, FIG. 2 shows a wearable audio device 10 in the form of a personal communications headset (e.g. an aviation headset). Reference numbers followed by an "A" or a "B" indicate a feature that corresponds to the right side or the left side, respectively, of the audio device 10. The audio device 10 includes a headband having an arcuate section 130, a right end and a left end. A right housing 132A and a left housing 132B are located at the right end and the left end, respectively, of the headband. The arcuate section 130 serves as an over-the-head bridge between the right and left housings 132. A spring band 134 (e.g., spring steel) extends from the right housing 132A, through the arcuate section 130 and to the left housing 132B. The spring band 134 provides a clamping force to move the housings 132 toward each other (approximately along a horizontal plane through the wearer's head) while the headband is worn by a user. The right and left housings 132 can be moved a distance either up and toward or down and away from the arcuate section 130 to accommodate a smaller or larger head, respectively.

A pad (right pad 136A or left pad 136B, generally 136) is attached to each housing 132 and is used to comfortably secure the headset 10 to the head. As used herein, a "pad" means a compliant member that can compress and/or deform under an applied pressure and that is configured for contact with the head of a user in a manner that supports the headband. In some cases, when the audio device (headset) 10 is worn on the head, each pad 136 extends from its forward end above the ear to its back end, which is lower on the head and behind the ear. In certain cases, the pads 136 each have a contoured surface 138 for contacting the head of the user. A boom 140 extends from a rotatable base 142 near the bottom of one of the housings (e.g., as illustrated, the right housing 132A) and is used to position and support a microphone 144 attached at the other end. The boom 140 may be adjusted, in part, by rotation about its base 142 to place the microphone 144 in proper position with respect to the mouth of the user. The boom 140 may be permanently affixed to the housing 132A or may be removable so that the audio device 10 can be used for both aviation and non-aviation uses (e.g., music playback). A connector 146 for a communications cable extends from the bottom of the right housing 132A. An earpiece (e.g., earbud) connector cable 148 extends at one end from each housing 132. The opposite end of the flexible cable 148 is suitable for connecting to an earpiece such as an earbud or other type of in-ear headphone. Additional features of the audio device 10 in FIG. 2 are described in U.S. Pat. No. 10,187,718, which is entirely incorporated by reference herein.

Figure 3:
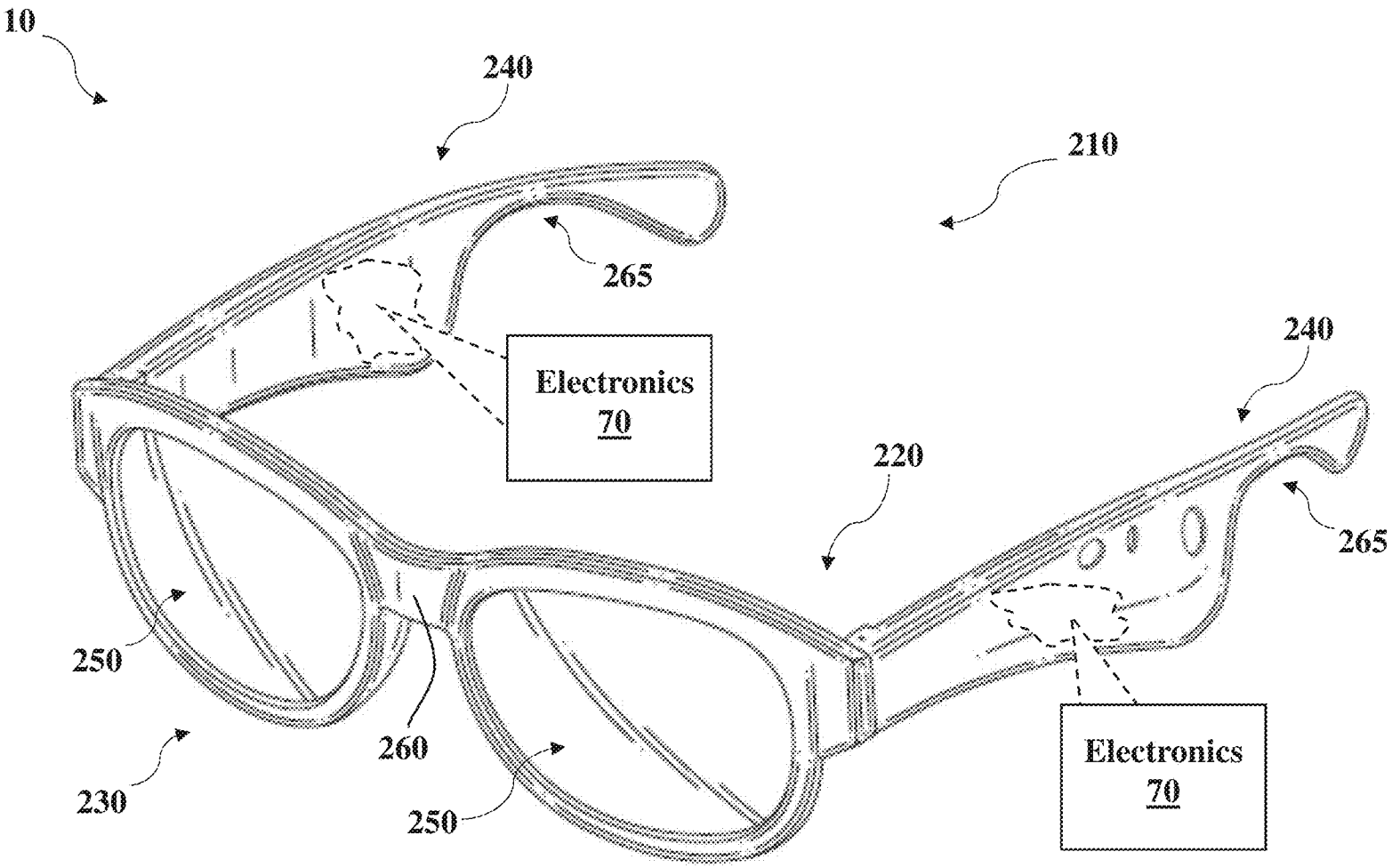
FIG. 3 is a schematic depiction of an additional audio device according to various implementations.

FIG. 3 illustrates an additional example audio device 10, including audio eyeglasses 210. As shown, the audio eyeglasses 210 can include a headband (e.g., frame) 220 having a lens region 230 and a pair of arms 240 extending from the lens region 230. As with conventional eyeglasses, the lens region 230 and arms 240 are designed for resting on the head of a user. The lens region 230 can include a set of lenses 250, which can include prescription, non-prescription and/or light-filtering lenses, as well as a bridge 260 (which may include padding) for resting on the user's nose. Arms 240 can include a contour 265 for resting on the user's respective ears. Contained within the frame 220 (or substantially contained, such that a component can extend beyond the boundary of the frame) are electronics 70 and other components for controlling the audio eyeglasses 210 according to particular implementations. Electronics 70 can include portions of, or connectors for, one or more electronic components as described with respect to the audio devices 10 herein. In some cases, separate, or duplicate sets of electronics 70 are contained in portions of the frame, e.g., each of the respective arms 240 in the frame 220. However, certain components described herein can also be present in singular form.

Figure 4:
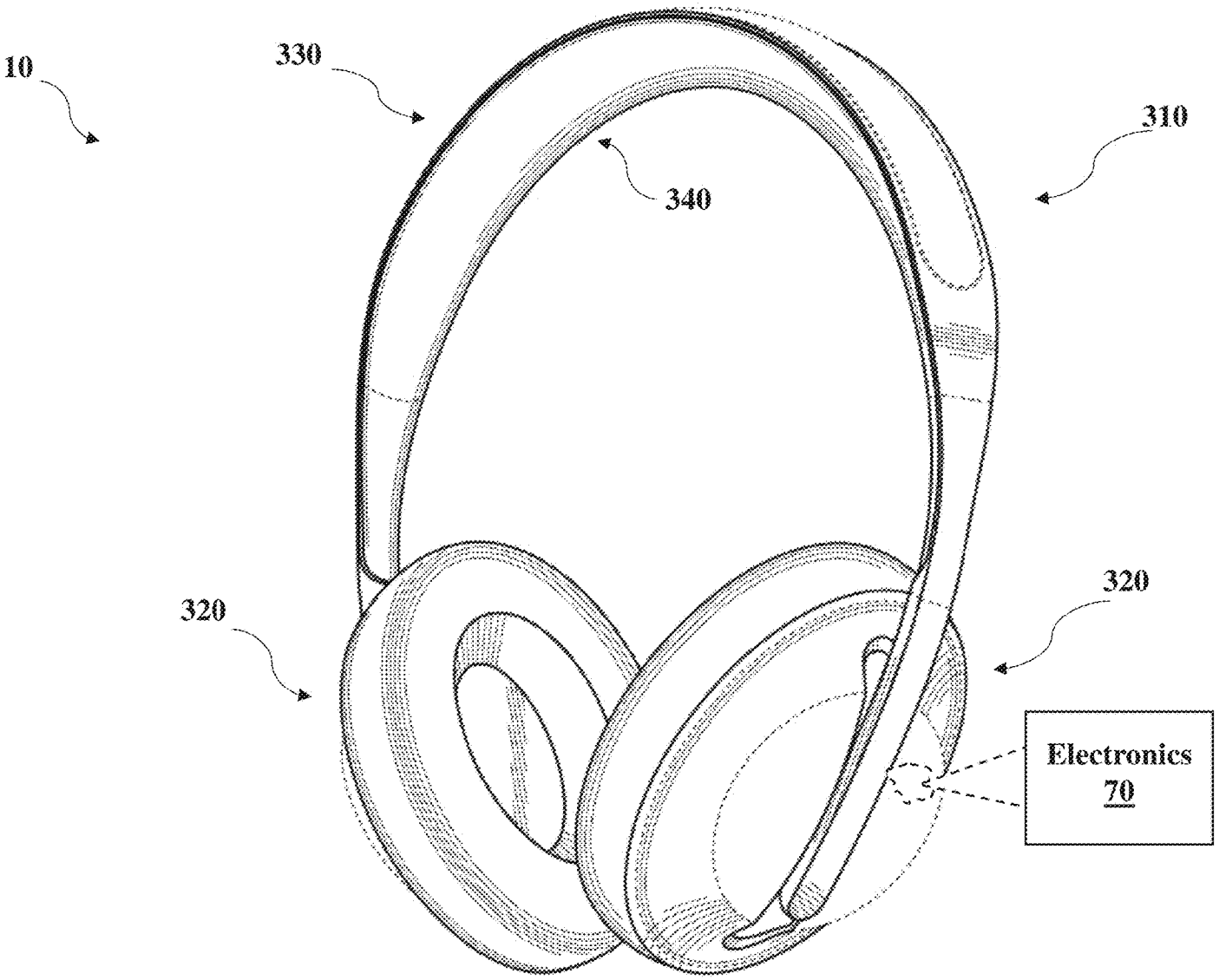
FIG. 4 is a schematic depiction of another audio device according to various implementations.

FIG. 4 depicts another audio device 10, including around-ear headphones 310. Headphones 310 can include a pair of earpieces (e.g., ear-cups) 320 configured to fit over the ear, or on the ear, of a user. A headband 330 spans between the pair of earpieces 320 and is configured to rest on the head of the user (e.g., spanning over the crown of the head or around the head). The headband 330 can include a head cushion 340 in some implementations. Stored within one or both of the earpieces 320 are electronics 70 and other components for controlling the headphones 310 according to particular implementations. Electronics 70 can include portions of, or connectors for, one or more electronic components as described with respect to the audio devices 10 herein. It is understood that a number of wearable audio devices described herein can utilize the features of the various implementations, and the wearable audio devices 10 shown and described with reference to FIGS. 1-4 are merely illustrative.

Figure 5:
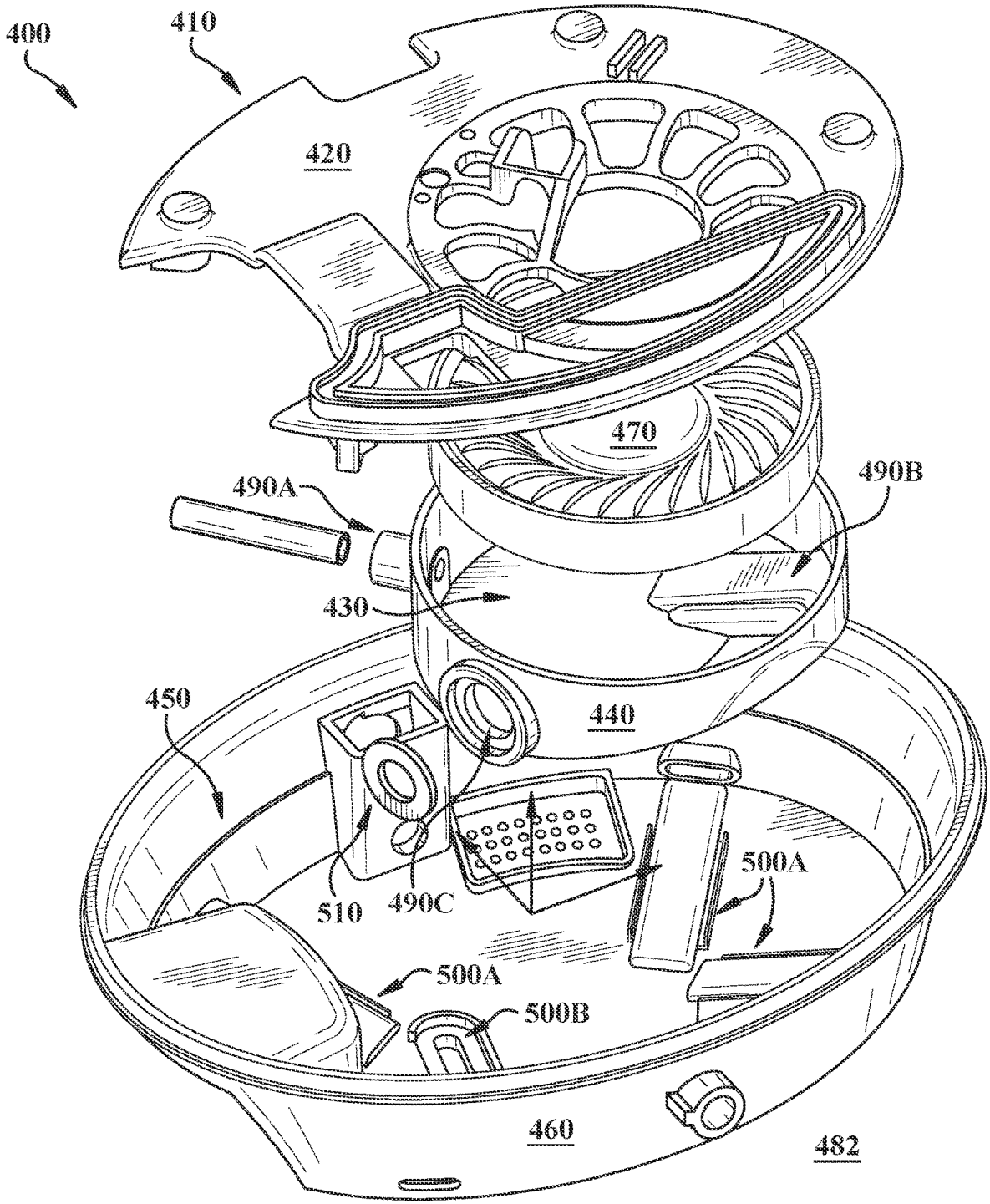
FIG. 5 is a perspective break-away view of an earpiece according to various implementations.
Figure 6:
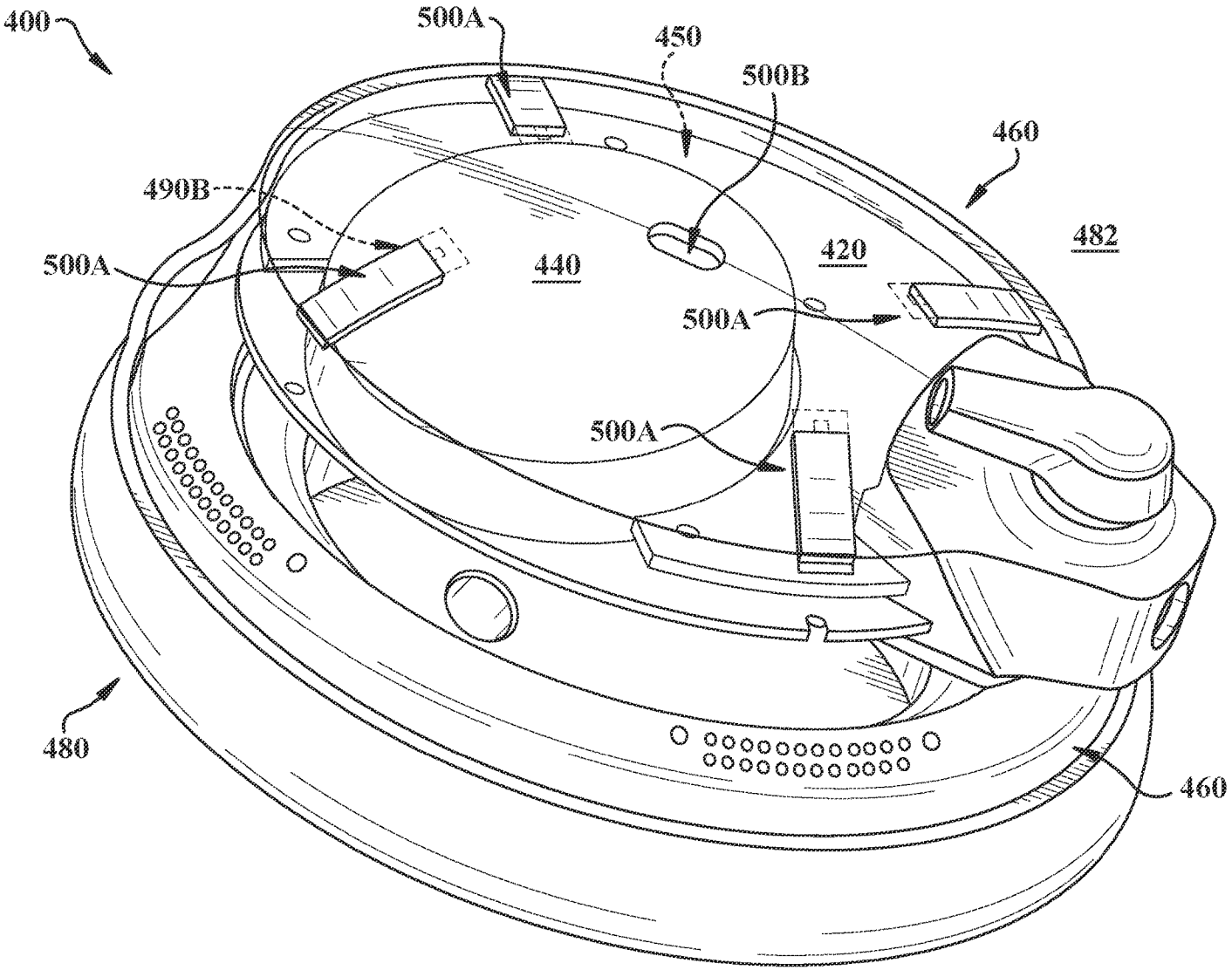
FIG. 6 is a perspective, partially transparent view of a portion of an earpiece according to various implementations.

FIG. 5 shows a perspective break-away view of an earpiece 400 according to various implementations. The earpiece 400 can form part of any audio device 10 illustrated or described herein, e.g., as earpiece 105 in the aviation headset in FIG. 1, an earbud coupled with the connector 148 in the aviation headset in FIG. 2, an on-ear, over-ear earpiece in or otherwise connected with the audio eyeglasses in FIG. 3, and/or an ear-cup 320 in the headset shown in FIG. 4. FIG. 6 shows a perspective, partially transparent view of a portion of the earpiece 400 from the back (or, exterior when worn by a user). FIGS. 5 and 6 are referred to simultaneously.

To avoid obscuring the principles of the various implementations, many conventional components of the earpiece are not described in detail. As shown in particular in FIG. 5, in various implementations the earpiece 400 includes a first (or, front) cavity 410 partially enclosed by a first shell 420, a second cavity 430 partially enclosed by a second shell 440, and a third cavity 450 partially enclosed by a third shell 460. A driver (or, electroacoustic transducer) 470 that is configured to provide an acoustic output is disposed between the first cavity 410 and the second cavity 430. The first cavity 410 couples sound output by the driver 470 to the user's ear. In certain implementations, the second cavity 430 has a smaller acoustic volume than the first cavity 410 and the third cavity 450. According to particular implementations, the acoustic volume of each cavity 410, 430 and/or 450 is adjustable using one or more fillers, such that the mechanical volume of the cavity/cavities is larger than the acoustic volume. In these cases, the acoustic volume of a given cavity can be adjusted or otherwise controlled by the addition or removal of a filler material, e.g., a porous foam that may include one or more natural mineral compounds.

As described herein, in various implementations, the third shell 460 is a cover for the earpiece 400. That is, in various implementations, the third shell 460 is part of the outermost layer of the earpiece 400, defining the back of the third cavity 450 (relative to the user's ear). In various implementations, the third shell 460 is coupled with a compliant member 480 (FIG. 6), such as an ear cushion, pad or nozzle for engaging the user's ear or a region proximate the user's ear. In some cases, the third shell 460 is sealed with (or, sealingly engaged with) the compliant member 480. In certain implementations, other than the ports described herein, the third shell 460 seals the third cavity 450 such that air from the third cavity 450 can only escape to the ambient environment (or, ambient) 482 through those ports. That is, but for those ports, this third shell 460 seals the outside of the earpiece 400.

In various implementations, a first mass and/or resistive port 490 connects the second cavity 430 and third cavity 450, and a second mass and/or resistive port 500 is connected to the third cavity 450. In certain implementations, the third cavity 450 is coupled to the ambient 482 by the second mass and/or resistive port 500. In particular cases, the second mass and/or resistive port 500 is the only outlet to ambient from the third cavity 450. That is, in certain implementations where the third shell (cover) 460 is part of the outermost layer of the earpiece 400, the second mass and/or resistive port 500 vents directly to ambient.

According to certain implementations, each mass and/or resistive port (e.g., mass and/or resistive ports 490, 500) includes: a) a mass port; b) a resistive port; c) a mass port and a resistive port; or d) a single port that is both massive and resistive. Examples of mass ports can include mass port tubes and sliding mass ports, and examples of resistive ports can include resistive port screens. Both types of port, as well as ports that include both a mass port and a resistive port or have both massive and resistive characteristics, impede air flow.

In one example implementation, as depicted in FIG. 5, the first mass and/or resistive port 490 is shown as including one or more of: a first mass port 490A (e.g., mass port tube), a second mass port 490B (e.g., a sliding mass port), or a resistive port 490C (e.g., including a resistive port screen, or mesh 510). Mass ports 490A, 490B are calibrated in a predefined ratio to the mass of the air within the second cavity 430. In the mass port tube example indicated by 490A, the volume in the tube relates to the volume in the second cavity 430. In the sliding mass port example indicated by 490B, the weight of the sliding mass relates to the volume of the second cavity 430. In certain implementations, the term "first mass and/or resistive port 490" refers to one or more of these ports. Additionally, while one of each type of mass and/or resistive port 490 is illustrated in FIG. 5, it is understood that a plurality of each type, or only one or two types of mass and/or resistive port 490 can be arranged, e.g., in the second shell 440. In some particular implementations, the first mass and/or resistive port 490 is further connected to the third cavity 450 and/or ambient 482. For example, where the first mass and/or resistive port is a sliding mass port 490B, that sliding mass port 490B can be fluidly connected with a mass port or opening in the third shell 460 (e.g., one of mass ports 500A shown in third shell 460), enabling airflow from the second cavity 430, either into the second cavity 430 from the first cavity 410 or through the third cavity 450 to ambient 482.

In some implementations, as depicted in FIGS. 5 and 6, the second mass and/or resistive port 500 is shown including one or more of: a mass port 500A (e.g., a sliding mass port) or a resistive port 500B (e.g., including a resistive port screen, or mesh, not illustrated). In this example, a plurality of mass ports 500A are shown, e.g., two or more mass ports 500A, with four shown in the particular depiction in FIG. 6. In other implementations, up to eight (8) mass ports 500A are coupled with the third cavity 450 (e.g., integrated in or otherwise coupled with the third shell 460) for permitting airflow from the third cavity 450 to ambient 482. It is understood that distinct configurations (e.g., number, size and/or position) of mass and/or resistive ports 500 can be used to achieve similar performance benefits in accordance with the various implementations. In certain implementations, for given cut-off frequency, dynamic range and linearity parameters, adjusting the number of mass and/or resistive ports 500 includes adjusting a size of each of the mass and/or resistive ports 500 to maintain these parameters. While a single resistive port 500B is shown, in various implementations the earpiece 400 includes two or more resistive ports 500B connected to the third cavity 450 (e.g., located in the third shell 460). In a particular implementation, up to three, and in some cases, four resistive ports 500B are located between the third cavity 450 and ambient 482.

It is understood that various implementations can provide benefits relative to conventional earpieces that include front and rear cavities, e.g., as described in U.S. Pat. No. 9,762,990 ("Headset Porting"), which is incorporated by reference in its entirety. As in some conventional ported earpieces with front and rear cavities, the earpiece 400 according to various implementations can include at least one equalization port (not shown) connected to the first cavity 510. These conventional ported earpieces can also include at least one mass port and at least one resistive port connected to the second cavity 430. In some cases, the mass port includes a mass port tube such as mass port 490A, or a sliding mass port such as mass port 490B. In certain cases, the resistive port includes a screened port similar to resistive port 490C. As described herein, in various implementations earpiece 400 can also include an additional port (e.g., a mass and/or resistive port as described herein) connected to the first cavity 410, the second cavity 430, the third cavity 450 or ambient 482. The sealed third cavity 450 and configuration of first and second mass and/or resistive ports 490, 500 can enhance the functionality of the earpiece 400 when compared with conventional earpieces and related headsets.

In various implementations, the earpiece 400 can provide significant performance benefits and/or user experience benefits relative to conventional audio devices. For example, in some cases, the third cavity 450 and the second mass and/or resistive port 500 maintain passive attenuation of an ear canal of a user at frequencies of ambient noise that range between approximately 500 Hertz (Hz) and approximately 2,000 Hz, while maintaining compliance at frequencies below approximately 500 Hz. That is, the earpiece 400 is configured to adapt to changing acoustic environments in order to maintain desirable levels of passive attenuation and/or compliance. In particular examples, the third cavity 450 and the second mass and/or resistive port 500 act as a low pass filter at frequencies of ambient noise below approximately 500 Hz. In any case, the earpiece 400 enhances the user experience relative to conventional audio devices.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

Other embodiments not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

We claim:

1. A wearable audio device, comprising:
a first cavity;
a second cavity;
a third cavity;
a driver disposed between the first cavity and the second cavity, the driver configured to provide an acoustic output;
a first mass and/or resistive port connecting the second cavity and the third cavity;
a second mass and/or resistive port connected to the third cavity; and
three or more additional mass and/or resistive ports connected to the third cavity,
wherein the first mass and/or resistive port is a first sliding mass port, wherein the second mass and/or resistive port is a second sliding mass port, and wherein the first sliding mass port and the second sliding mass port are aligned to enable airflow from the second cavity, through the third cavity, to the ambient environment outside of the wearable audio device.

2. The wearable audio device of claim 1, further comprising:
at least one mass port connected to the second cavity;
at least one resistive port connected to the second cavity; and
an additional port connected to two of: the first cavity, the second cavity, the third cavity or the ambient environment outside of the wearable audio device,
wherein the additional port comprises a mass and/or resistive port.

3. The wearable audio device of claim 1, wherein the wearable audio device comprises one of: an over-ear audio device, an on-ear audio device or an in-ear audio device.

4. The wearable audio device of claim 1, wherein each mass and/or resistive port comprises: a) a mass port; b) a resistive port; c) a mass port and a resistive port; or d) a single port that is both massive and resistive.

5. The wearable audio device of claim 1, further comprising a cover defining the third cavity.

6. The wearable audio device of claim 5, wherein the second mass and/or resistive port and each of the three or more additional mass and/or resistive ports is connected to the ambient environment outside of the wearable audio device,
wherein the cover is part of an outermost layer of the wearable audio device such that the second mass and/or resistive port vents to the ambient environment and the at least three additional mass and/or resistive ports vent to the ambient environment.

7. The wearable audio device of claim 1, further comprising an equalization port connected to the first cavity.

8. The wearable audio device of claim 1, wherein the second cavity has a smaller acoustic volume than the first cavity and the third cavity.

9. The wearable audio device of claim 1, wherein the third cavity and the second mass and/or resistive port maintain passive attenuation of an ear canal of a user at frequencies of ambient noise that range between approximately 500 Hertz (Hz) and approximately 2,000 Hz, while maintaining compliance at frequencies below approximately 500 Hz,
wherein the third cavity and the second mass and/or resistive port act as a low pass filter at frequencies of ambient noise below approximately 500 Hz.

10. The wearable audio device of claim 1, wherein the second mass and/or resistive port is a resistive port and each of the three or more additional mass and/or resistive ports is a mass port.

11. The wearable audio device of claim 10, wherein the three or more additional mass and/or resistive ports comprise four mass ports.

12. A wearable audio device, comprising:
a set of earpieces, each comprising:
a first cavity;
a second cavity;
a third cavity;
a driver disposed between the first cavity and the second cavity, the driver configured to provide an acoustic output;
a first mass and/or resistive port connecting the second cavity and the third cavity;
a second mass and/or resistive port connected to the third cavity; and
at least two additional mass and/or resistive ports connected to the third cavity and the ambient environment outside of the wearable audio device,
wherein the second cavity has a smaller acoustic volume than the first cavity and the third cavity,
wherein the third cavity and the second mass and/or resistive port maintain passive attenuation of an ear canal of a user at frequencies of ambient noise that range between approximately 500 Hertz (Hz) and approximately 2,000 Hz, while maintaining compliance at frequencies below approximately 500 Hz,
wherein the second mass and/or resistive port connects the third cavity with the ambient environment, and the at least two additional mass and/or resistive ports connect the third cavity with the ambient environment, and
wherein the first mass and/or resistive port is a first sliding mass port, wherein the second mass and/or resistive port is a second sliding mass port, and wherein the first sliding mass port and the second sliding mass port are aligned to enable airflow from the first cavity, through the second cavity, to the ambient environment.

13. The wearable audio device of claim 12, wherein the third cavity and the second mass and/or resistive port act as a low pass filter at frequencies of ambient noise below approximately 500 Hz.

14. A wearable audio device, comprising:
a set of earpieces, each comprising a cover at least partially containing:
a first cavity;
a second cavity;

a third cavity;

a driver disposed between the first cavity and the second cavity, the driver configured to provide an acoustic output;

a first mass and/or resistive port connecting the second cavity and the third cavity; and a second mass and/or resistive port connected to the third cavity, wherein the cover defines an outer bound of the third cavity, wherein the second mass and/or resistive port is the only outlet to the ambient environment from the third cavity, and wherein the third cavity and the second mass and/or resistive port maintain passive attenuation of an ear canal of a user at frequencies of ambient noise that range between approximately 500 Hertz (Hz) and approximately 2,000 Hz, while maintaining compliance at frequencies below approximately 500 Hz, wherein the wearable audio device comprises one of: an over-ear audio device or an on-ear audio device.

15. The wearable audio device of claim 14, wherein the second mass and/or resistive port fluidly couples the third cavity to the ambient environment outside of the wearable audio device, wherein the cover is part of an outermost layer of the wearable audio device such that the second mass and/or resistive port vents to the ambient environment.

* * * * *